US005191764A

United States Patent [19]

Silvestri, Jr.

[11] Patent Number: 5,191,764

[45] Date of Patent: Mar. 9, 1993

[54] GOVERNOR VALVE POSITIONING TO OVERCOME PARTIAL-ARC ADMISSION LIMITS

[75] Inventor: George J. Silvestri, Jr., Winter Park, Fla.

[73] Assignee: Westinghouse Electric Corp., Pittsburgh, Pa.

[21] Appl. No.: 896,039

[22] Filed: Jun. 9, 1992

[51] Int. Cl.[5] ..... F01K 13/02

[52] U.S. Cl. ..... 60/660

[58] Field of Search ..... 60/646, 652, 657, 660, 60/664, 665, 667

[56] References Cited

U.S. PATENT DOCUMENTS

| | | | |
|---|---|---|---|
| 3,097,488 | 7/1963 | Eggenberger et al. | 60/73 |
| 3,241,322 | 3/1966 | Strohmeyer, Jr. | 60/73 |
| 4,178,762 | 12/1979 | Binstock et al. | 60/667 |
| 4,187,685 | 2/1980 | Tsuji et al. | 60/660 |
| 4,280,060 | 7/1981 | Kure-Jensen et al. | 60/646 |
| 4,297,848 | 11/1981 | Silvestri, Jr. et al. | 60/600 |
| 4,320,625 | 3/1982 | Westphal et al. | 60/646 |
| 4,888,954 | 12/1989 | Silvestri, Jr. | 60/660 |

OTHER PUBLICATIONS

Stodola; "Steam and Gas Turbines with a Supplement on the Prospects of the Thermal Primer Mover"; McGraw-Hill Book Co., Inc.; vol. 1; pp. 189-190.

G. W. Bouton et al.; "Ten Years Experience with Large Pulverized Coal-Fired Boilers for Utility Service", Apr. 26-28, 1982; pp. 19-21.

L. G. Crispin et al.; "Jacksonville Electric Authority's Conversion of a Subcritical Once-Through Unit to Variable Pressure Cycling Duty"; pp. 1-7.

Silvestri, Jr. et al.; "Recent Developments in the Application of Partial-Arc Turbines to Cyclic Service"; Electric Power Institute; Oct. 20-22, 1987; pp. 1-20.

Silvestri, Jr. et al.; "An Update on Partial-Arc Admission Turbines for Cycling Applications"; Electric Power Research Institute; Nov. 5-7, 1985; pp. 1-23.

Silvestri, Jr.; "Steam Cycle Performance"; Power Division, American Society of Mechanical Engineers; pp. 9-10.

Erbes & Eustis; "A Computer Methodology for Predicting the Design and Off-Design Performance of Utility Steam Turbine-Generators"; Proceedings of the American Power Conference, Illinois Institute of Technology; 1986; vol. 48; pp. 318-320.

*Primary Examiner*—Allen M. Ostrager

[57] ABSTRACT

Method for improving the heat rate of a steam turbine operated in a partial-arc mode includes sequential closing of control valves to establish a first arc of admission at which pressure drop on a first control stage reaches a predetermined level. Steam pressure to the turbine may then be reduced in combination with valve closing to maintain first stage pressure at or below the predetermined level. In a further method, low power operation is achieved by maintaining a constant arc of admission while simultaneously moving all open valves toward a closed position.

7 Claims, 6 Drawing Sheets

GOVERNOR VALVE POSITIONING TO OVERCOME PARTIAL-ARC ADMISSION LIMITS

This invention relates to steam turbines and, more particularly, to a method and apparatus for improving the heat rate (efficiency) of a partial-arc admission steam turbine.

BACKGROUND OF THE INVENTION

The power output of many multi-stage steam turbine systems is controlled by throttling the main flow of steam from a steam generator in order to reduce the pressure of steam at the high pressure turbine inlet. Steam turbines which utilize this throttling method are often referred to as full arc turbines because all steam inlet nozzle chambers are active at all load conditions. Full arc turbines are usually designed to accept exact steam conditions at a rated load in order to maximize efficiency. By admitting steam through all of the inlet nozzles, the pressure ratio across the inlet stage, e.g., the first control stage, in a full arc turbine remains essentially constant irrespective of the steam inlet pressure. As a result, the mechanical efficiency of power generation across the control stage may be optimized. However, as power is decreased in a full arc turbine, there is an overall decline in efficiency, i.e., the ideal efficiency of the steam work cycle between the steam generator and the turbine exhaust, because throttling reduces the energy available for performing work. Generally, the overall turbine efficiency, i.e., the actual efficiency, is a product of the ideal and the mechanical efficiency of the turbine.

More efficient control of turbine output than is achievable by the throttling method has been realized by the technique of dividing steam which enters the turbine inlet into isolated and individually controllable arcs of admission. In this method, known as partial-arc admission, the number of active first stage nozzles is varied in response to load changes. Partial arc admission turbines have been favored over full arc turbines because a relatively high ideal efficiency is attainable by sequentially admitting steam through individual nozzle chambers with a minimum of throttling, rather than by throttling the entire arc of admission. The benefits of this higher ideal efficiency are generally more advantageous than the optimum mechanical efficiency achievable across the control stage of full arc turbine designs. Overall, multi-stage steam turbine systems which use partial-arc admission to vary power output operate with a higher actual efficiency than systems which throttle steam across a full arc of admission. However, partial-arc admission systems in the past have been known to have certain disadvantages which limit the efficiency of work output across the control stage. Some of these limitations are due to unavoidable mechanical constraints, such as, for example, an unavoidable amount of windage and turbulence which occurs as rotating blades pass nozzle blade groups which are not admitting steam.

Furthermore, in partial-arc admission systems the pressure drop (and therefore the pressure ratio) across the nozzle blade groups varies as steam is sequentially admitted through a greater number of valve chambers, the largest pressure drop occurring at the minimum valve point (fewest possible number of governor or control valves open) and the smallest pressure drop occurring at full admission. The thermodynamic efficiency, which is inversely proportional to the pressure differential across the control stage, is lowest at the minimum valve point and highest at full admission. Thus, the control stage efficiency for partial-arc turbines as well as full arc turbines decreases when power output drops below the rated load.

Sliding or variable throttle pressure operation of partial-arc turbines also results in improved turbine efficiency and additionally reduces low cycle fatigue. The usual procedure is to initiate sliding pressure operation on a partial-arc admission turbine at flows below the value corresponding to the point where half the control valves are wide open and half are fully closed, i.e., 50% first stage admission on a turbine in which the maximum admission is practically 100%. If sliding pressure is initiated at a higher flow (larger value of first stage admission), there is a loss in performance. However, in a turbine having eight valves, sliding from 75% admission eliminates a considerable portion of the valve loop (valve throttling) on the sixth valve which would occur with constant throttle 1 pressure operation. A similar situation occurs when sliding from 62.5% admission, i.e., a considerable portion of the valve loop of the fifth valve is eliminated. Elimination of such portions of valve loops improves the turbine heat rate and its efficiency.

FIG. 1 illustrates the effect of sliding pressure control in a partial-arc steam turbine having eight control valves. The abscissa represents values of steam flow while the ordinate values are heat rate. Line 10 represents constant pressure with throttling control while line 12 represents sliding pressure on a full arc admission turbine. Line 14 represents constant pressure with sequential valve control (partial-arc admission) and dotted lines 16, 18, 20 and 22 represent the valve loops. The valve loops result from gradual throttling of each of a sequence of control or governor valves. Sliding pressure operation from 75% admission is indicated by line 24. Note that much of the valve loop 20 is eliminated by sliding pressure along line 24 but that heat rate (the reciprocal of efficiency) increases disproportionately below the 62.5% admission point. Line 26, showing sliding pressure from the 62.5% admission point, provides some improvement but does not affect valve loops 16, 18 and 20. Similarly, sliding from 50% admission, line 28, helps at the low end but does not affect valve loops 16–22. Each of these valve loops represent higher heat rates and reduced efficiency from the ideal curve represented by line 14.

FIGS. 2, 3 and 4 illustrate the operation of an exemplary steam turbine using one prior art control. FIG. 2 shows the locus of full valve points, line 30, with constant pressure operation at 2535 psia. The valve points are at 50%, 75%, 87.5% and 100% admission with the valve loops identified by the lines 32, 34 and 36. Sliding pressure is indicated by lines 38, 40 and 42. Starting at 100% admission, about 806 MW for the exemplary turbine system, load is initially reduced by keeping all eight control valves wide open and sliding throttle pressure by controlling the steam producing boiler. When the throttle pressure, line 38, reaches the intersection point with the valve loop 32, the throttle pressure is increased to 2535 psia while closing the eighth control valve. The control valve would continue to close as load is further reduced while maintaining the 2535 psia throttle pressure until this valve is completely closed at which point the turbine is operating at 87.5% admission. To further reduce load, valve position is again held constant, seven valves fully open, and throttle pressure is again reduced until the throttle pressure corresponds to the intersection of the sliding pressure line 40 and the valve loop 34 for the seventh valve. To reduce load below this point, the pressure is increased to 2535 psia and the seventh valve is progressively closed (riding down the valve loop) until it is completely closed. The admission is now 75%. To reduce load still further, the pressure is again reduced with six valves wide open and two fully closed until the throttle pressure line 42 reaches the intersection with the valve loop 36 where the fifth and sixth valves move simultaneously with constant throttle pressure operation. Then the operation of raising throttle pressure and closing of the valves is repeated for any number of valves desired. The variation in throttle pressure is illustrated in FIG. 3. The sloped portions 44 of line 46 relates to the sliding pressure regime with constant valve position. The vertical portions 48 relate to the termination of sliding pressure with no valve throttling and the uppermost point relates to operation at full pressure with valve throttling. The horizontal portions 50 relate to the riding down of the valve loop while reducing load at constant pressure. FIG. 4 shows the improvement in heat rate as a function of load. The line 52 illustrates the difference between valve loop performance at constant pressure and the performance with variable pressure between valve points.

The performance improvements shown in FIGS. 2 and 4 are based on the assumption that the boiler feed pump discharge is reduced as the throttle pressure is reduced. If it is not reduced proportionally, the improvement is reduced since the energy required to maintain discharge pressure remains high. In the prior art system, a signal is sent to the feed pump/feed pump drive system to reduce pressure. In reality, however, the feed pump is followed by a pressure regulator in order to eliminate the need for constant adjustment of pump speed and the occurrence of control instability and hunting because of small variations in inlet water pressure to the boiler, resulting from perturbations in flow demand. The regulator, then, does more or less throttling which changes pump discharge pressure and therefore the flow that the pump will deliver. The pump speed is held constant over a desired range of travel of the regulator valve. When the valve travel gets outside these limits, the pump speed is adjusted to move the valve to some desired mean position. As a consequence, the pump discharge pressure does not equal the minimum allowable value (throttle pressure plus system head losses) and so the performance improvement is not as large as shown by FIGS. 2 and 4. In addition, in order to achieve quicker load response, the regulator valve is usually operated with some pressure drop so that if there is a sudden increase in load demand, the valve can open quickly and increase flow. The response of the pump and its drive is slower than the response of the regulator valve.

While sliding throttle pressure operation improves part load performance of steam power plants, studies have demonstrated that the highest performance levels are achieved by partial-arc admission turbines which initially reduce load from the maximum value by successively closing governor or control valves (sequential valve operation) while holding throttle pressure constant. When half the control valves are wide open and half are closed (50% admission on the first stage), valve position is held constant and further load reductions are achieved by varying or sliding throttle pressure. This combined method of operation has been referred to as hybrid operation. Hybrid operation with the transition point at 50% admission is believed to be the most efficient operation. However, a partial-arc admission turbine is subjected to shock loading at part load as the rotating blades pass in and out of the active steam arc. As a result, the blades must be stronger, which affects the aspect ratio and consequently the efficiency. Blade material or blade root damping is desirable to reduce the vibration stresses associated with partial-arc admission. In addition, the kilowatt loading (bending forces) on the individual rotating blades increases as the arc of admission is decreased. Sliding pressure operation (hybrid operation, more particularly) reduces the shock loading on the turbine first stage because the optimum values of minimum admission are higher than with constant throttle pressure operation.

Obtaining a first stage blade material or design with the required damping and strength for partial-arc operation is more difficult at elevated steam pressures and temperatures, for example, 4500 psia and 1100° F., of today's turbines. This limitation forces such high pressure, high temperature turbines to be operated with full-arc admission first stages because suitable materials for partial-arc admission are not available. If a material cannot be found that will allow partial-arc admission at 50% admission, the minimum admission arc could be increased to 62.5% or 75% admission, for example, with some loss in performance. The performance level would still be better than a full-arc admission design operating with sliding throttle pressure. However, with minimum arcs of admission much above 75%, there is little benefit to hybrid operation. In other cases, older turbines of more conventional type, such as those operating at 1000° F. or 1050° F., have been stressed such that partial-arc operation is limited. For such turbines, it is desirable to provide a method for improving performance without exceeding minimum allowable stress conditions.

If, because of first stage distress during constant pressure operation, it is necessary to increase the primary admission arc above 50%, the power plant owner and operator will experience a reduction in plant efficiency (higher heat rate). If the turbine is now operated in the hybrid mode, the reduction in plant efficiency will be much less. There will however, still be some decrease in plant efficiency compared to the original operating procedure. This is illustrated by the attached table. These data were developed for a 500 MW rated output turbine with valve points at 50%, 62.5%, 75% and 100% admission. FIG. 7 is a schematic of the nozzle chambers (admission area) for the 8 valve 500 MW unit. At 50% admission, chambers A, BC and D are active. AT 62.5% admission, chamber E is also active.

Suppose that the turbine could operate with hybrid variable pressure starting at 50% admission. At loads below 334.9 MW, Table III, the throttle pressure would be varied to control load while above 334.9 MW, control valves would be modulated to control load. In this instance, for the power range between 334.9 MW and 405.8 MW, there would be throttling on one control valve of the 50% admission design, in this instance chamber E.

The design limited to 62.5% minimum admission would vary throttle pressure on all five active arcs of admission for loads below 405.8 MW (Table III). Conventional practice has been to limit the admission to the nearest valve point where control stage reliability is assured. In actual turbines, the partial-arc (first) stage usually has some additional design margin at this admission where reliability is assured.

SUMMARY OF THE INVENTION

The method of the present invention is described in a system in which a combination of control valve closure, sliding pressure and valve throttling is utilized to achieve better efficiency. In one embodiment, the method is illustrated for use in a turbine system in which the control stage can only tolerate the combined stresses of partial-arc shock loading and pressure drop corresponding to a 62.5% arc of admission due to material and blade root fastening limitations. Initial turbine power reduction is achieved by sequentially closing control valves to reduce the arc of admission to 62.5% at full operating steam pressure. Further reduction is achieved by partially closing the control valve which would normally be used to reduce admission to 50%. This last control valve is only closed until the pressure drop across the first stage reaches a maximum allowable value. At that point, the control valves are essentially all locked in place and further power reduction is achieved in one form by reducing steam pressure to the turbine. In the event that the system is not capable of sliding steam pressure, power reduction is achieved by concurrently closing each remaining open control valve in uniform increments so that the first stage pressure drop does not exceed the maximum allowable value. The process of closing all valves simultaneously may also be used when steam pressure in the system has been reduced to its minimum allowable value.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 5:
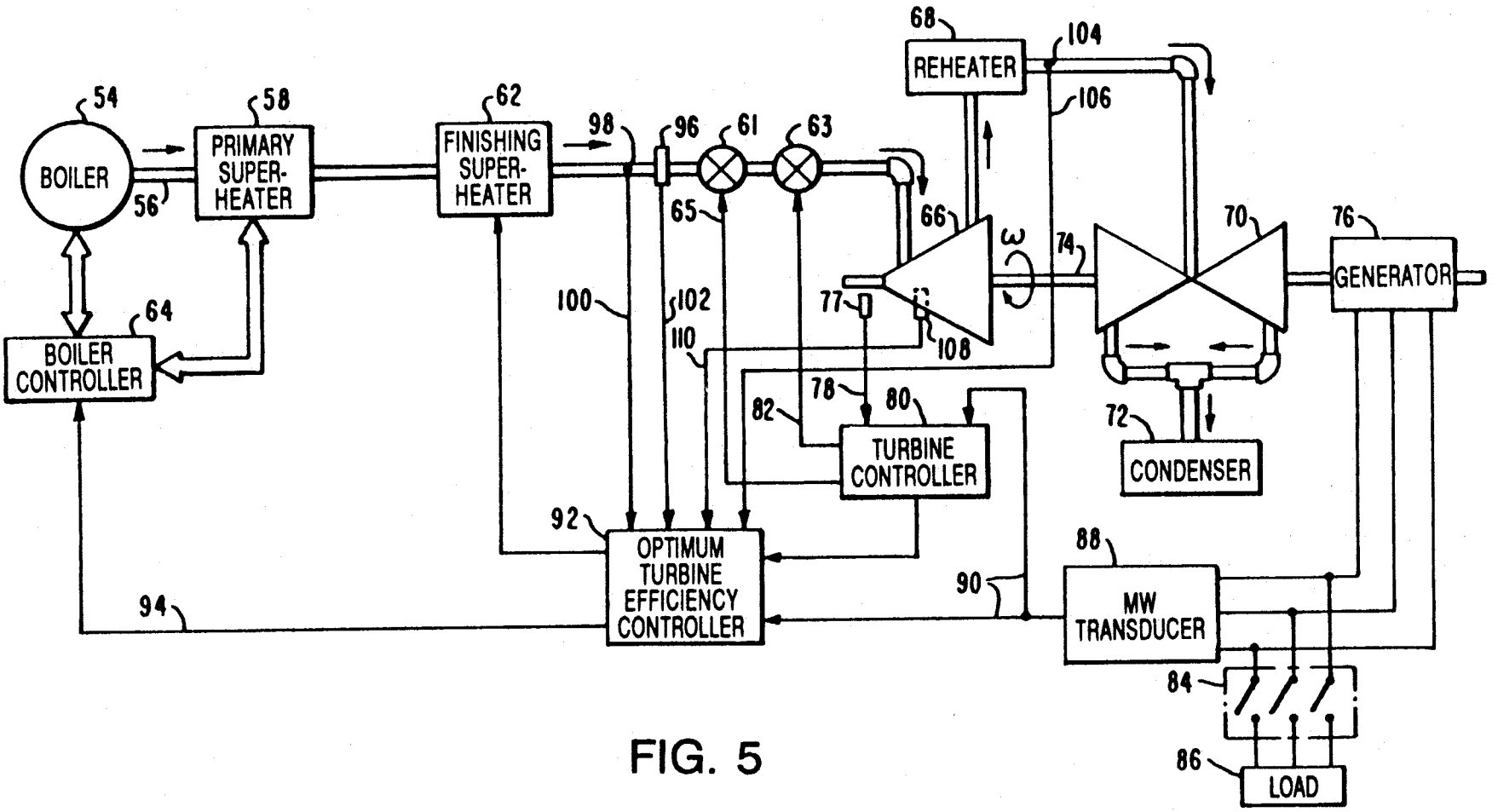
FIG. 5 is an illustration of one form of system for implementing the method of the present invention.

Before describing the method of the present invention, reference is first made to FIG. 5 which depicts a functional block diagram schematic of a typical steam turbine power plant suitable for embodying the principles of the present invention. In the plant of FIG. 5, a conventional boiler 54 which may be of a nuclear fuel or fossil fuel variety produces steam which is conducted through a header 56, primary superheater 58, a finishing superheater 62 and throttle valve 61 to a set of partial-arc steam admission control valves depicted at 63. Associated with the boiler 54 is a conventional boiler controller 64 which is used to control various boiler parameters such as the steam pressure at the header 56. More specifically, the steam pressure at the header 56 is usually controlled by a set point controller (not shown) disposed within the boiler controller 64. Such a set point controller arrangement is well known to all those skilled in the pertinent art and therefore, requires no detailed description for the present embodiment. Steam is regulated through a high pressure section 66 of the steam turbine in accordance with the positioning of the steam admission valves 63. Normally, steam exiting the high pressure turbine section 66 is reheated in a conventional reheater section 68 prior to being supplied to at least one lower pressure turbine section shown at 70. Steam exiting the turbine section 70 is conducted into a conventional condenser unit 72.

In most cases, a common shaft 74 mechanically couples the steam turbine sections 66 and 70 to an electrical generator unit 76. As steam expands through the turbine sections 66 and 70, it imparts most of its energy into torque for rotating the shaft 74. During plant startup, the steam conducted through the turbine sections 66 and 70 is regulated to bring the rotating speed of the turbine shaft to the synchronous speed of the line voltage or a subharmonic thereof. Typically, this is accomplished by detecting the speed of the turbine shaft 74 by a conventional speed pickup transducer 77. A signal 78 generated by transducer 77 is representative of the rotating shaft speed and is supplied to a conventional turbine controller 80. The controller 80 in turn governs the positioning of the steam admission valves using signal lines 82 for regulating the steam conducted through the turbine sections 66 and 70 in accordance with a desired speed demand and the measured speed signal 78 supplied to the turbine controller 80. The throttle valve 61 may be controlled at turbine start-up thus allowing the control valves 63 to be fully open until the turbine is initially operating at about five percent load. The system then transitions to partial- arc operation and the throttle valve 61 fully opened. However, the throttle valve 61 is generally an emergency valve used for emergency shut-down of the turbine. The line 65 from controller 80 provides control signals to valve 61.

A typical main breaker unit 84 is disposed between the electrical generator 76 and an electrical load 86 which for the purposes of the present description may be considered a bulk electrical transmission and distribution network. When the turbine controller 80 determines that a synchronization condition exists, the main breaker 84 may be closed to provide electrical energy to the electrical load 86. The actual power output of the plant may be measured by a conventional power measuring transducer 88, like a watt transducer, for example, which is coupled to the electrical power output lines supplying electrical 1 energy to the load 86. A signal which is representative of the actual power output of the power plant is provided to the turbine controller 80 over signal line 90. Once synchronization has taken place, the controller 80 may conventionally regulate the steam admission valves 63 to provide steam to the turbine sections 66 and 70 commensurate with the desired electrical power generation of the power plant.

In accordance with the present invention, an optimum turbine efficiency controller 92 is disposed as part of the steam turbine power plant. The controller 92 monitors thermodynamic conditions of the plant at a desired power plant output by measuring various turbine parameters as will be more specifically described herebelow and with the benefit of this information governs the adjustment of the boiler steam pressure utilizing the signal line 94 coupled from the controller 92 to the boiler controller 64. In the present embodiment, the boiler pressure adjustment may be accomplished by altering the set point of a set point controller (not shown) which is generally known to be a part of the boiler controller 64. As may be the case in most set point controllers, the feedback measured parameter, like steam pressure, for example, is rendered substantially close to the set point, the deviation usually being a function of the output/input gain characteristics of the pressure set point controller. The controller 92 also supplies signals via line 46 to superheater 62 to control the final steam temperature.

Turbine parameters like throttle steam pressure and temperature are measured respectively by conventional pressure transducer 96 and temperature transducer 98. Signals 100 and 102 generated respectively by the transducers 96 and 98 may be provided to the optimum turbine efficiency controller 92. Another parameter, the turbine reheat steam temperature at the reheater 68 is measured by a conventional temperature transducer 104 which generates a signal on line 106 to the controller 92 for use thereby. The signal on line 90 which is generated by the power measuring transducer 88 may be additionally provided to the controller 92. Moreover, an important turbine parameter is one which reflects the steam flow through the turbine sections 66 and 70. For the purposes of the present embodiment, the steam pressure at the impulse chamber of the high pressure turbine section 68 is suitably chosen for that purpose. A conventional pressure transducer 108 is disposed at the impulse chamber section for generating and supplying a signal 110, which is representative of the steam pressure at the impulse chamber, to the controller 92.

One embodiment of the turbine efficiency controller 92 sufficient for describing the operation of the controller 92 in more specific detail is shown in U.S. Pat. No. 4,297,848 assigned to the assignee of the present invention, the disclosure of which is hereby incorporated by reference.

As described in the aforementioned U.S. Pat. No. 4,297,848, the controller 92 and the controller 80 may include microcomputer based systems for computing appropriate set points, e.g., throttle pressure and steam flow, for optimum operation of the steam turbine system in response to load demands. In the present invention, it is desirable to control throttle steam pressure applied to valves 63 in order to optimize system efficiency while having the ability to rapidly respond to increased load demand. The system of FIG. 5 achieves this result by controlling the boiler 54, primary superheater 58 and the finishing superheater 62 in a manner to regulate throttle steam pressure and temperature.

Figure 6:
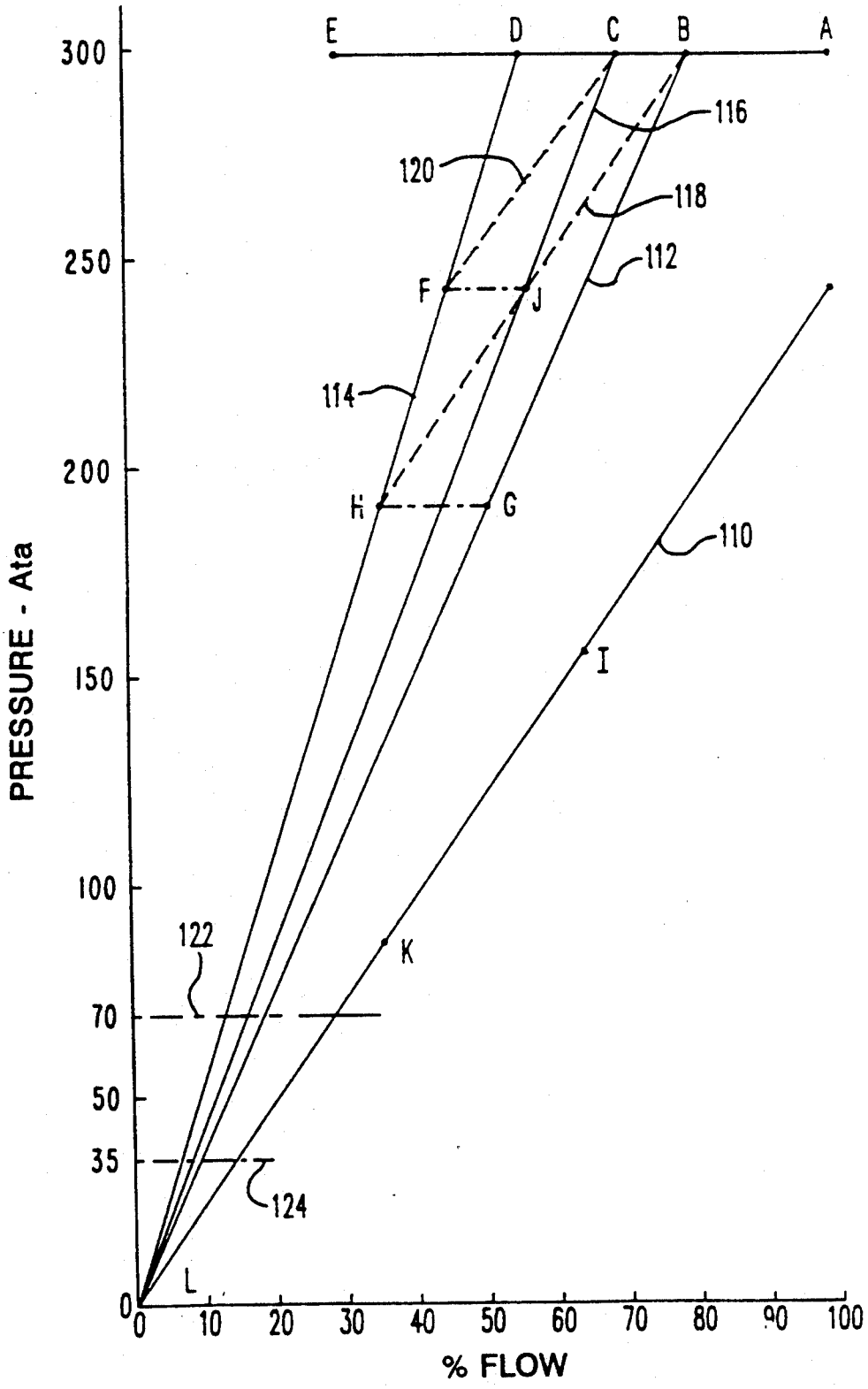
FIG. 6 is a chart illustrating a method of operating a steam turbine.

The method of operation of the system of FIG. 5 can best be understood by reference to FIG. 6 which illustrates a plurality of steam flow versus steam pressure diagrams for various partial-arc admissions of a high temperature, high pressure steam turbine. For purposes of discussion, it is assumed that the design of this turbine is such that the control stage blading is limited to 75% admission at full operating steam pressure, i.e., about 4300 psia at the inlet to the control stage nozzles. Line 110 represents the pressure drop across the control stage (nozzle inlet to impulse chamber). Line A, B, C, D, E represents full operating steam pressure. For example, the control stage pressure drop at full arc is about 850 psia, i.e., the difference between point 110A and 4300 psia. The maximum allowable pressure drop occurs at 75% admission and is about 1500 psia. Lines 122 and 124 bracket a typical minimum pressure zone for most utility turbines, i.e., a pressure between 500 and 1000 psia. Control valves 63 are sequentially closed to reduce the arc of admission to 75% in response to load demands determined by controllers 80 and 92. At point B of FIG. 6, representing 75% admission, the controllers hold admission constant while reducing throttle steam pressure along line 112 to point G. Pressure is then held constant and additional valves are closed to bring the turbine operating point to point H on the 50% admission line 114. The difference between the pressure at point H and the impulse chamber pressure at point K is essentially the same as between points B and 110A so that the shock stresses at 50% admission are no greater than the design limit at 75% admission and should be lower because of the lower steam density.

If the turbine were designed to withstand shock loading at 62.5% admission at full pressure, the initial power reduction can be achieved by closing control valves 63 following line A, B, C, D to point C. Steam pressure can then be reduced along line 116 to point J. At that point, pressure is held constant and additional valves 63 are closed to reach point F. Further power reduction is achieved by reducing pressure along line F-L.

The controllers 80, 92 can also be programmed to adjust steam pressure and close valves 63 concurrently so that turbine operation follows line 118 directly from point B to point H. Such operation may require alternate adjustment of pressure and valve closure so that line 118 appears more as a stair-step than a linear path. The same approach can be used o transition from point C to point F along line 120. In this method, the differential pressure 1 is maintained substantially constant, i.e., lines 110, 118 and 120 are substantially parallel. This method of operation is more efficient than the first disclosure method since it maintains the control stage at its designed pressure drop.

Figure 1:
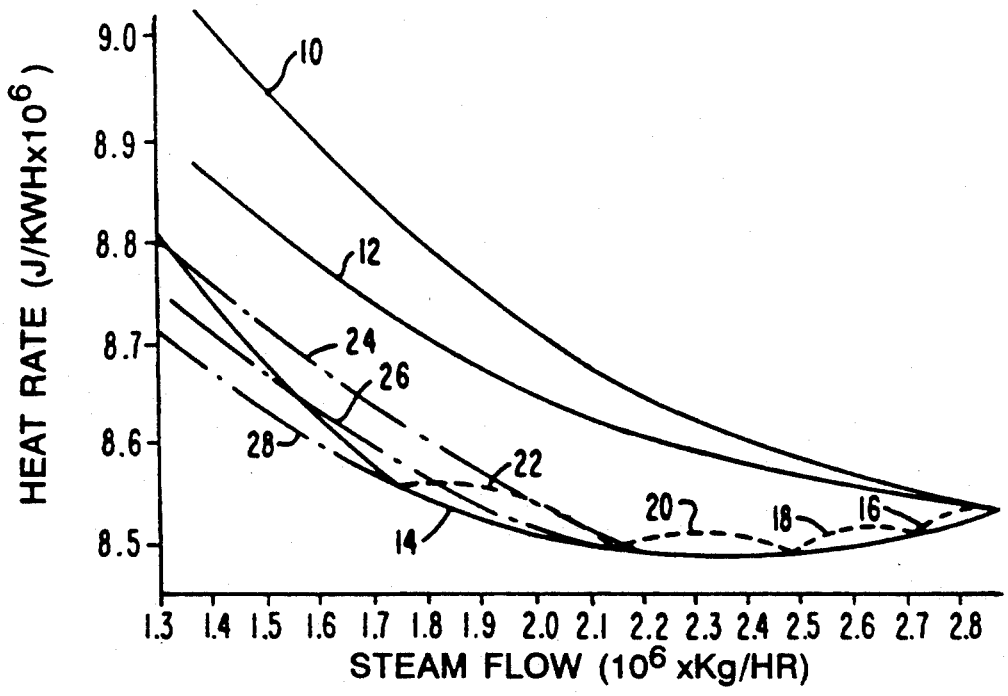
FIG. 1 is a sequence of steam flow versus heat rate curves characteristic of one prior art method of steam turbine control.
Figure 2:
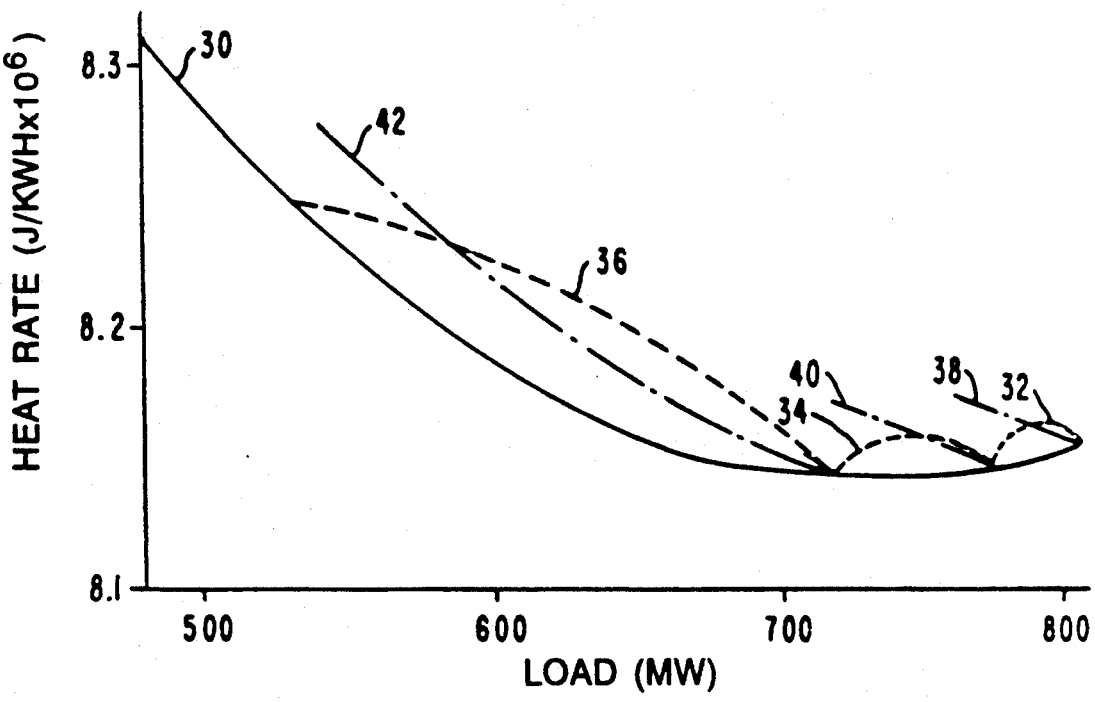
FIG. 2 is a curve characteristic of another prior art method of control of a steam turbine.
Figure 3:
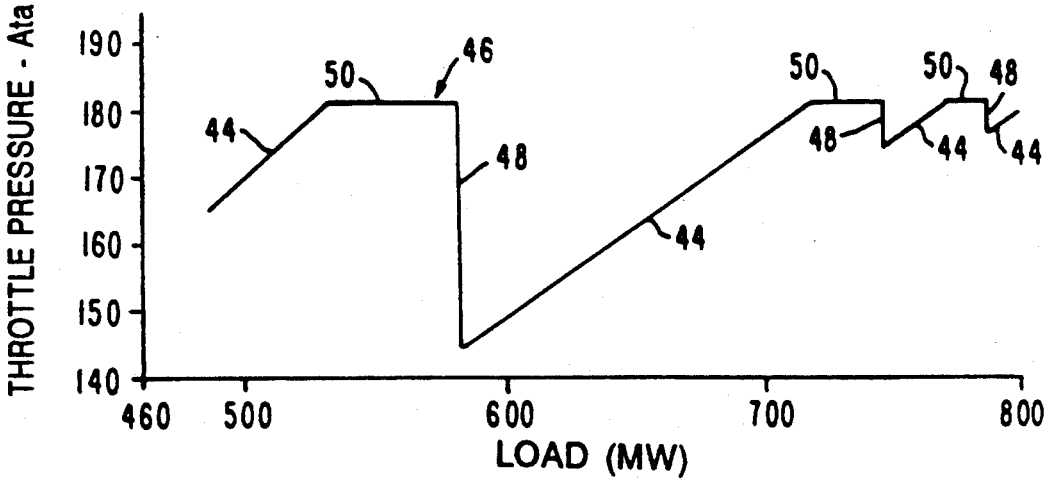
FIG. 3 illustrates throttle pressure as a function of load for the method of FIG. 2.
Figure 4:
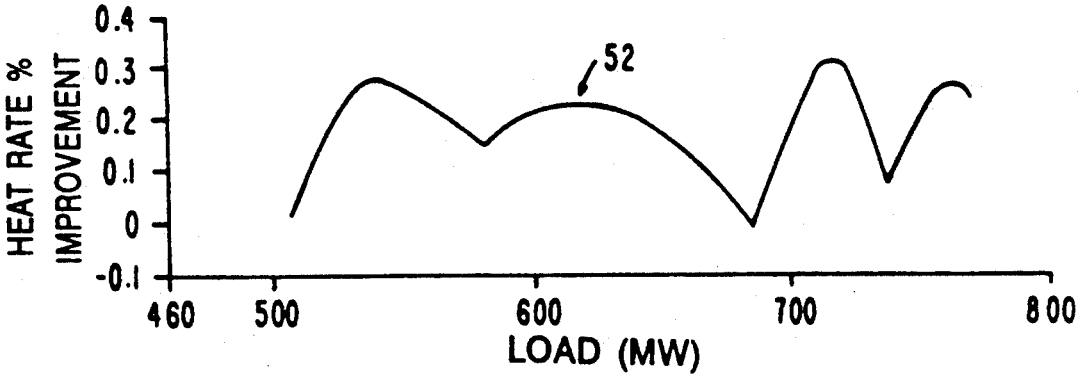
FIG. 4 illustrates calculated efficiency improvement for the method of FIG. 2.

In general, both of the above methods of operation follow the same pattern once 50% admission is reached, i.e., pressure is allowed to slide until a minimum pressure is reached, typically about 600–1000 psia on turbines operating at a design throttle pressure of 2400 psia. For loads requiring less than this minimum pressure at minimum design admission, throttling of the control valves is used to reduce power output. However, as was shown in FIG. 1, throttling produces a higher heat rate and is therefore less efficient. However, Applicant has found that even though such turbines are designed to operate at optimum at some set admission, e.g., 62.5% admission, additional improvement in heat rate can be attained by further reducing the arc of admission at low or minimum steam pressures. Table I illustrates a typical set of heat rates for an exemplary turbine with inlet steam conditions of 2400 psia and temperature of 1000° operating at low loads and a minimum pressure of 600 psia. Note that there is a small improvement between 50% admission and 37.5% admission although there is no additional improvement in going to 25% admission. However, Table II illustrates that an improvement can be realized at 25% admission for a 2400 psia design throttle pressure turbine operating at a minimum throttle pressure of 1000 psia. Thus, this method of operation reduces heat rates when minimum throttle pressure is used and provides a benefit from operation at lower values of admission without detrimental effect on the control stage blading.

The above described methods of turbine operation have been based upon the assumption that a preselected group of valves may be closed to bring power down. However, as the control stage is stressed by cycling of the turbine, the predetermined maximum allowable control stage pressure drop is reduced. Table III illustrates data for a turbine in which the original design allowed operation at full pressure down to a 50% arc of admission, but in which repeated cycling has stressed the blading such that a maximum allowable control stage pressure drop is now 1083 psia for reliable operation. Note that the control stage pressure drop is 973 psia at 62.5% admission and 1231 psia at 50% admission. Thus, reliable operation within the stress limits occurs between a valve point at 62.5% and a valve point at 50% admission. Note also that at 49% load (243.3 MW), the design limited to 62.5% admission incurs a heat rate penalty of 81 BTU/KWH which continues to increase for decreasing load. At 29% load (145.4 MW), the heat rate penalty at 62.5% admission is 152 BTU/KWH.

The present invention provides a heat rate improvement by partially closing the control valve that supplies the 12.5% admission arc between 50% and 62.5% admission. This control valve is allowed to close to the point at which the first stage pressure drop reaches the predetermined maximum allowable drop, i.e., 1083 psia in this example. Table III shows a heat rate improvement of 48 BTU/KWH using partial closure as compared to operation at 62.5% admission at 243.3 MW. At a load of 145.4 MW, this method improves heat rate by 105 BTU/KWH. When the control valve has been partially closed such that the pressure drop has reached the maximum allowable value, further power reduction is attained by sliding pressure in the manner described above, unless the turbine is of a type in which pressure is not variable. In that instance, it has been found that reliable operation is possible by concurrently closing all open control valves by substantially identical increments. This latter technique can also be used if steam pressure has been reduced to a minimum value, such as that represented by line 122 in FIG. 6.

Figure 7:
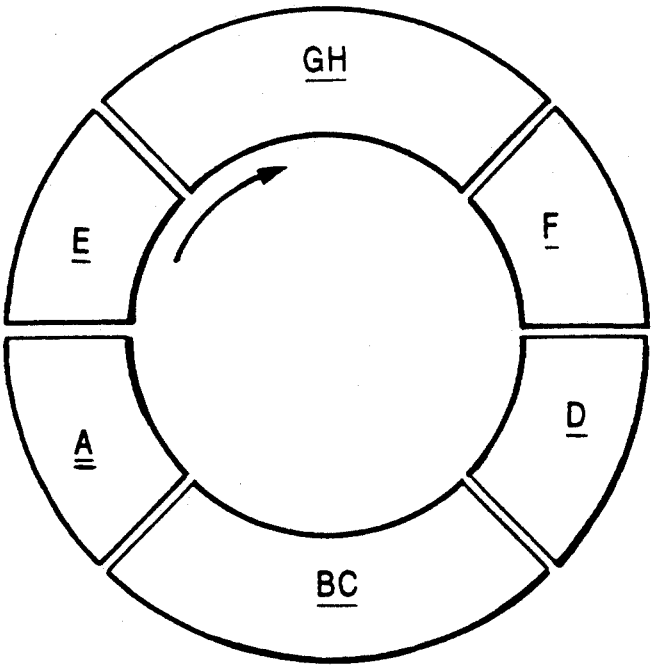
FIG. 7 is an illustrative turbine admission diagram.

Referring to FIG. 7, the present invention proposes variable pressure operation in which control valve position is held constant with four valves wide open (feeding steam to chambers A, BC and D) and one partially closed valve feeding steam to chamber E for an exemplary eight control valve system. If pressure can be reduced while holding valve positions constant, an improvement in heat rate over the fixed 62.5% admission can be realized. An additional improvement can be obtained by interrupting steam pressure reduction at a predetermined point and reducing load by completely closing the valve controlling chamber E, i.e, the partially open valve. Once the chamber E valve is closed, load is again reduced by sliding pressure downward.

Figure 8:
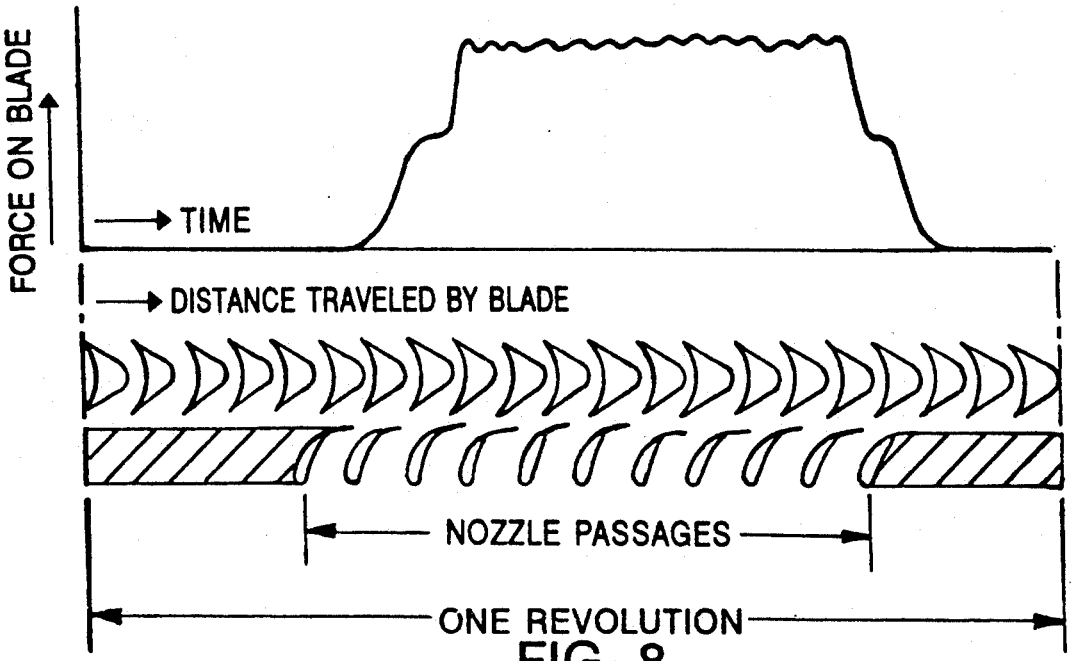
FIG. 8 is a general diagram of intermittent steam load for a partial-arc turbine.
Figure 9:
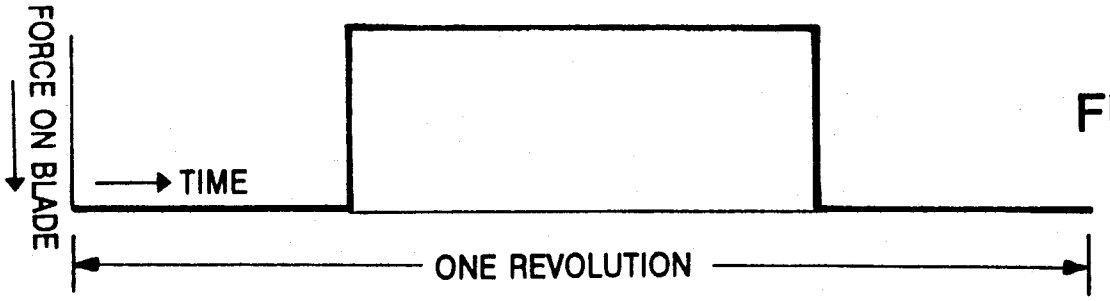
FIG. 9 is a simplified blade-load diagram for the turbine of FIG. 8.
Figure 10:
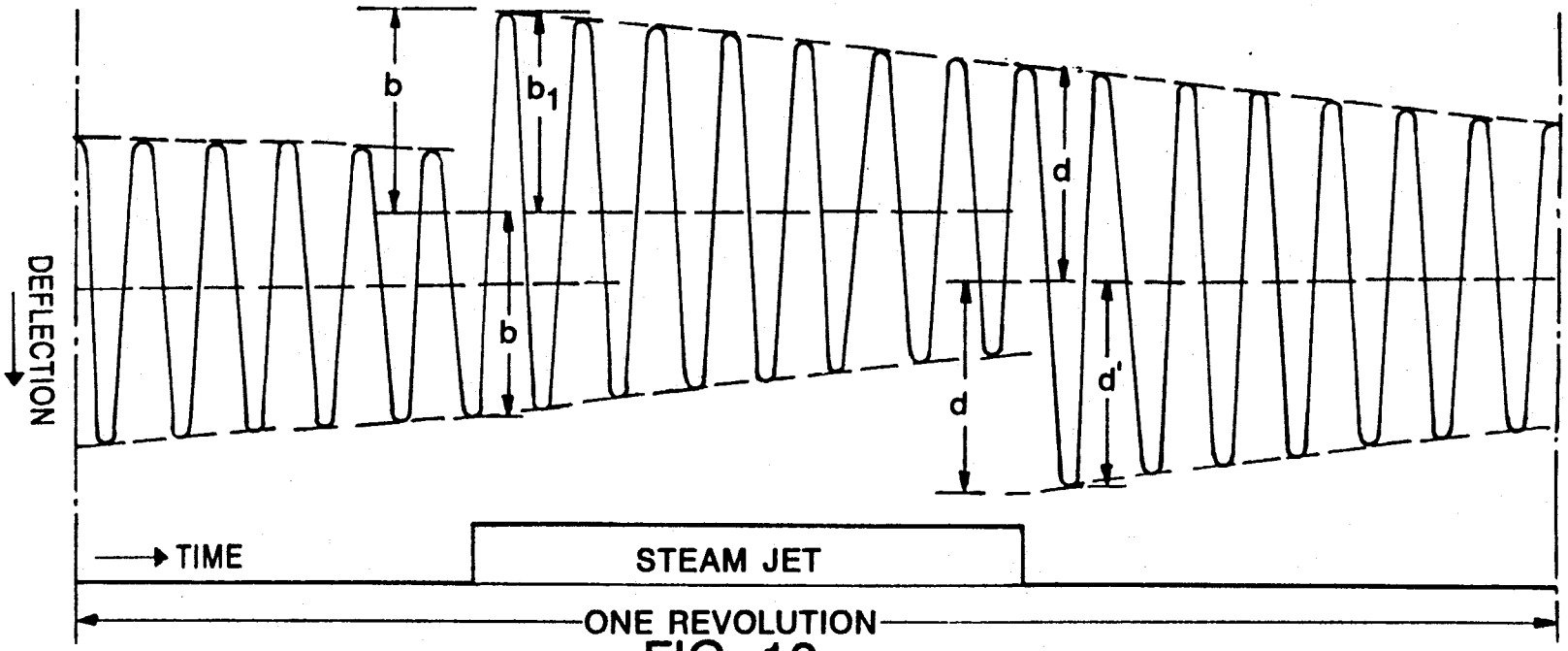
FIG. 10 is a graph of vibration amplitude due to blades passing through steam jets.

When a turbine is operated in the partial-arc admission mode, the control stage rotating blades experience shock loading as they pass in and out of the active admission arc. In addition, the blades are subjected to vibratory stimulus. The resulting blade loading was investigated by R. P. Kroon in the late 1930's and reported in an ASME paper "Turbine-Blade Vibration due to Partial Admission", *Journal of Applied Mechanics*, vol. 7, pp. A161–165, Dec. 1940. FIGS. 8, 9 and 10 illustrate the forces and vibration that occur during partial-admission. Note that the vibratory force is higher when the blades leave the active jet than when they enter the active jet. Compare the sum of b and b1 to the sum of d and d' on FIG. 10.

If the arc with the partially closed valve (chamber E) is the trailing admission arc during operation, it will cushion the rebounding force, d', of FIG. 10, there is no steam admission on the side of the admission arc that has wide open control valves supplying it. In the case of FIG. 7 and with the indicated clockwise rotation, the trailing admission is chamber E. If the partially throttled arc leads (is ahead) of the fully active arc, it would reduce the magnitude of b1 in FIG. 10. In this instance, chamber F of FIG. 7 is the leading admission arc. In this instance, the magnitudes of b1 and c of FIG. 10 would be reduced and consequently the sum of d and d' would be lower. However, a partially open trailing chamber is the preferred embodiment.

The above described procedure can be used on operating turbines that have experienced first stage distress from use or to obtain a more optimum transition load when switching from constant to variable pressure operation. The procedure can also be used on full-arc admission turbines to improve part load performance while still admitting steam to all of the admission arcs.

TABLE I

| | 600 Psia Pressure Heat Rate Comparison (BTU/KWH) | | | |
|---|---|---|---|---|
| % Load | 62.5% Adm. | 50% Adm. | 37.5% Adm. | 25% Adm. |
| 17 | 9654 | 9649 | 9649 | 9649 |
| 13.6 | 10089 | 9927 | 9927 | 9927 |
| 10.3 | 10781 | 10593 | 11492 | 10492 |
| 7.7 | 11675 | 11448 | 11238 | 11238 |

TABLE II

| | 1000 Psia Pressure Heat Rate Comparison (BTU/KWH) | | | |
|---|---|---|---|---|
| % Load | 62.5% Adm. | 50% Adm. | 37.5% Adm. | 25% Adm. |
| 30.2 | 8768 | 8763 | 8763 | 8763 |
| 29.8 | 8935 | 8874 | 8874 | 8873 |
| 23.5 | 9137 | 9010 | 9010 | 9010 |
| 20.1 | 9390 | 9252 | 9218 | 9218 |
| 16.8 | 9710 | 9563 | 9426 | 9426 |
| 13.5 | 10156 | 9993 | 9842 | 9834 |
| 10.2 | 10867 | 10678 | 10501 | 10336 |
| 7.6 | 11792 | 11563 | 11352 | 11154 |

TABLE III

| | 500 MW Rated Load | | |
|---|---|---|---|
| Load | Heat Rate, Btu/kwh | | |
| MW | 50% Adm. | 62.5% Adm. | Proposed |
| 405.8 | 7958 | 7958(2) | 7958 |
| 373.3 | 8019 | 8013 | 8019(3) |
| 355.3 | 8043 | 8054 | 8048 |
| 339.5 | 8056 | 8084 | 8077 |
| 334.9 | 8060(1) | 8096 | 8086 |
| 323.7 | 8084 | 8123 | 8109 |
| 307.7 | 8119 | 8167 | 8147 |
| 291.7 | 8158 | 8214 | 8188 |
| 275.7 | 8202 | 8268 | 8234 |
| 259.5 | 8253 | 8327 | 8286 |

TABLE III-continued

| Load | 500 MW Rated Load Heat Rate, Btu/kwh | | |
|---|---|---|---|
| MW | 50% Adm. | 62.5% Adm. | Proposed |
| 243.3 | 8312 | 8393 | 8345 |
| 227.1 | 8378 | 8469 | 8415 |
| 210.8 | 8455 | 8555 | 8494 |
| 194.5 | 8543 | 8653 | 8584 |
| 178.1 | 8652 | 8767 | 8689 |
| 161.8 | 8765 | 8895 | 8807 |
| 145.4 | 8907 | 9059 | 8954 |

(1)Control Stage Pressure Drop = 1231 psia
(2)Control Stage Pressure Drop = 973 psia
(3)Control Stage Pressure Drop = 1083 psia

What is claimed is:

1. A method for improving heat rate of a partial-arc steam turbine, the turbine including a plurality of control valves each arranged for admitting steam to a predetermined arc of admission at a control stage of the turbine, the method comprising the steps of:

selecting a maximum allowable control stage pressure drop;

determining an arc of admission range including the maximum allowable control stage pressure drop at normal turbine operating pressure, the range being defined by upper and lower valve points operatively associated with one of the control valves;

sequentially closing each of the control valves for reducing turbine output power while holding steam pressure substantially constant until the control stage pressure drop reaches a value predeterminately less than the maximum allowable control stage pressure drop and the one of the control valves is only partially closed; and holding each control valve in its respective present position while reducing steam pressure to control turbine output power.

2. The method of claim 1 and including the step of simultaneously varying the position of each open control valve for controlling turbine output power when steam pressure is less than a predetermined minimum value.

3. The method of claim 1 and including the step of selecting a control valve for throttling steam flow such that the throttled steam flow occurs in an arc of admission immediately following an arc of admission having a fully open control valve.

4. The method of claim 1 and including the step of selecting a control valve for throttling steam flow such that the throttled steam flow occurs in an arc of admission immediately preceding an arc of admission having a fully open control valve.

5. A method for improving heat rate of a partial-arc steam turbine, the turbine including a plurality of control valves each arranged for admitting steam to a predetermined arc of admission at a control stage of the turbine, the method comprising the steps of:

selecting a maximum allowable control stage pressure drop;

determining an arc of admission range including the maximum allowable control stage pressure drop at normal turbine operating pressure, the range being defined by upper and lower valve points operatively associated with one of the control valves;

sequentially closing each of the control valves for reducing turbine output power while holding steam pressure substantially constant until the control stage pressure drop reaches a value predeterminately less than the maximum allowable control stage pressure drop and the one of the control valves is only partially closed; and simultaneously varying the position of each open control valve for controlling turbine output power when steam pressure is less than a predetermined minimum value.

6. The method of claim 5 and including the step of selecting a control valve for throttling steam flow such that the throttled steam flow occurs in an arc of admission immediately following an arc of admission having a fully open control valve.

7. The method of claim 5 and including the step of selecting a control valve for throttling steam flow such that the throttled steam flow occurs in an arc of admission immediately preceding an arc of admission having a fully open control valve.

* * * * *